United States Patent [19]

Waterhouse

[11] 4,188,931

[45] Feb. 19, 1980

[54] AUTOMOTIVE SELF-STARTING DEVICE

[76] Inventor: Richard E. Waterhouse, 16 Angell Ter., South Portland, Me. 04106

[21] Appl. No.: 933,099

[22] Filed: Aug. 11, 1978

[51] Int. Cl.[2] ..... F02N 11/08

[52] U.S. Cl. ..... 123/179 B; 123/179 BG; 290/38 C

[58] Field of Search ..... 123/179 B, 179 BG; 290/38 C, DIG. 3

[56] References Cited

U.S. PATENT DOCUMENTS

| | | | |
|---|---|---|---|
| 2,197,726 | 4/1940 | Johnson | 290/38 C |
| 2,579,958 | 12/1951 | Perhats | 123/179 B |
| 2,791,699 | 5/1957 | Taylor | 123/179 B |
| 2,924,209 | 2/1960 | Schott | 123/179 B |
| 2,949,105 | 8/1960 | Davis | 123/179 B |
| 3,357,417 | 12/1967 | Baumann | 123/179 BG |
| 3,414,734 | 12/1968 | Konrad | 123/179 BG |
| 3,443,557 | 5/1969 | Hebert | 123/179 B |
| 3,538,898 | 11/1970 | Egdemir | 123/179 BG |
| 3,543,302 | 11/1970 | Walthausen | 123/179 B |

*Primary Examiner*—Charles J. Myhre
*Assistant Examiner*—Andrew M. Dolinar
*Attorney, Agent, or Firm*—William Nitkin

[57] ABSTRACT

An automotive self-starting apparatus including a timer adapted to activate and deactivate a circuit designed to start the motor with an oil pressure sensor switch and a thermal circuit breaker adapted to stop the starter motor once the engine has started or if the engine has failed to start, to allow cranking of the starter motor only for a preselected time with rest intervals therebetween during the period of activation of the circuit by the timer.

2 Claims, 1 Drawing Figure

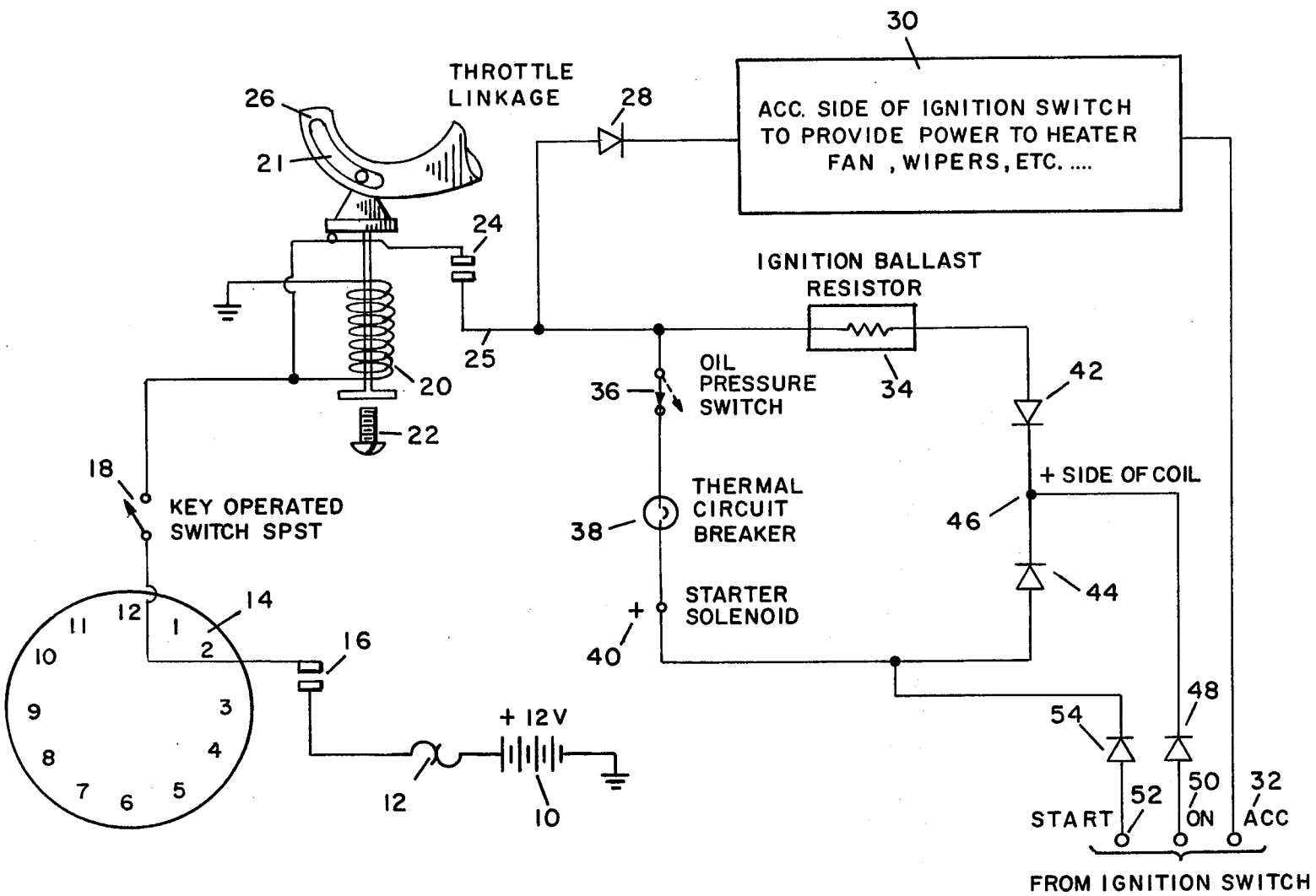
ACC. SIDE OF IGNITION SWITCH TO PROVIDE POWER TO HEATER FAN, WIPERS, ETC....
30
28
THROTTLE LINKAGE
26
21
24
25
20
22
IGNITION BALLAST RESISTOR
34
42
+ SIDE OF COIL
46
44
OIL PRESSURE SWITCH
36
THERMAL CIRCUIT BREAKER
38
STARTER SOLENOID
40
48
54
32
ACC
50
ON
52
START
FROM IGNITION SWITCH
+ 12V
10
12
16
14
KEY OPERATED SWITCH SPST
18
1
2
3
4
5
6
7
8
9
10
11
12

AUTOMOTIVE SELF-STARTING DEVICE

BACKGROUND OF THE INVENTION

1. Field of the Invention

The present invention relates to automatic starting devices for automobiles and more particularly relates to devices for the starting and stopping of automobile engines at preselected times.

2. Description of the Prior Art

In geographical areas experiencing cold climates it has long been practiced to start automobiles or other motor vehicles automatically before the operator arrives at the vehicle in order to warm up the vehicle's motor so that the vehicle can be driven immediately upon the user's arrival thereat. Further in such areas where snow may fall upon an ungaraged vehicle, it is desireable to start the vehicle and have the heater and defroster operate so that the snow on the vehicle's window surfaces can melt.

There have been many devices developed over the years to remotely and automatically start automobiles for the aforementioned purposes. Some of these devices have been patented such as in Pat. No. 2,992,335 by Boucher. The device of this patent utilizes a timer within a device with means to sense when an engine has started and if the engine has not started, it attempts over a period of time to successively start the engine. Another device described in U.S. Pat. No. 3,130,318 by Curtis discloses a device also having a timer and a vacuum mechanism to sense when a vehicle starts and to then shut down the starter motor. A more recent patent, being that of Gim Wong, Great Britain Pat. No. 1,385,135 discloses a starting device which has a clock which can be set to start the automobile at intervals throughout a twenty-four hour day which day can be selected during a seven day period as to when the engine will start and stop.

SUMMARY

It is an object of the present invention to provide an extremely simple automatic starting mechanism which in addition to the objects of the mechanisms cited above in the prior art can also prevent unauthorized use of the vehicle by an individual attempting to drive it away from its location once it has automatically started without the owner therein.

It is a further object of this invention to present a device which is simple in operation and which is superimposed upon the automobile's electric system.

Many of the parts of the device of this invention may be contained within an armored box and lodged within the passenger compartment, preferably under the dashboard of a vehicle and can be attached by lead wires to various points of the car as will be discussed below. The device of this invention utilizes a clock timing mechanism which can be structured to have the face of a standard clock with an adjustment member to set at the time of day at which the user wishes the vehicle to automatically start. It is envisioned that the clock timer of this invention will have associated therewith, when the preselected time is reached, a pair of contact points which will close to conduct a current therethrough and which will reopen after a preselected time such as 6–8 minutes. This closing of these contact points will complete the circuit to start the vehicle and since it is envisioned the clock can be contained within a locked armored casing, it cannot be readjusted by any unauthorized user. When the preselected time for the vehicle to start arrives, the clock closes the contact points for the preselected 6–8 minute period, the engine should run and once that time period has passed, the contacts will reopen and the car will cease to operate. This will have the effect of preventing the successful theft of an automobile that has self-started in that the user or thief when he takes the vehicle can only operate it for the 6–8 minute period. Also within the armored case is a key-operated switch which can be of the circular key variety or equivalent, and which will be in line with the contact points activated by the clock so as to turn the device of this invention off and not have it operate, if so desired. If the owner then decides to operate the device, he can insert and turn the key to the "on" position which will complete the circuit to the clock timer. It is envisioned that one pole of the contact points controlled by the clock will run to the positive pole of the battery of the vehicle and have along a line, a slow-blow fuse for protection of the system should malfunction occur. At the other point of the clock-activated contact points is a line which runs through the key-operated switch and, if one assumes that the switch is in its "on" mode, completes a circuit to a solenoid located at the throttle of the vehicle. This solenoid which is grounded and has length of pull adjustment means will move as current passes therethrough the throttle linkage of the car and close the choke of the vehicle. At the same time that the solenoid pulls on the throttle linkage, it will close a second pair of contacts through which the 12 volt positive current from the battery is conducted and this current then travels through a series of circuits. The first of these circuits is utilized to start the vehicle and extends through an oil pressure sensor switch which is normally closed allowing the passage of current. Upon the starting of the vehicle, the oil pressure therein increases and the oil pressure sensor switch being sensitive thereto, usually operating on a diaphragm principle, and which may be located near the oil filter, will open and will break the circuit which runs to the starter solenoid. While the oil pressure sensor switch is closed, the current runs therethrough to a thermal type circuit breaker sensitive to such current. Such thermal circuit breakers are well-known in the art and the type selected should allow the current to pass therethrough for a period of 30 seconds before breaking the circuit by opening. Once the thermal circuit breaker has opened, it is adapted to be of a type that will close in a preselected period such as 10 seconds. These time intervals can vary depending upon the user's wishes, the builder's wishes, and the design of the engine. In line with the thermal circuit breaker is the positive pole of the starter solenoid. As can be seen the 12 volt current now runs through the thermal circuit breaker switch while it and the oil pressure switch are closed thereby running the starter. This line from the starter solenoid continues through a diode to the positive side of the coil. A second line runs from the solenoid-controlled contact points through the ignition ballast resistor and a second diode also to the positive side of the coil. Once the automobile engine has started, this line keeps it running. It can be seen that when the clock closes the contact points, the current runs to the solenoid activating the throttle linkage closing the solenoid-controlled contact points, and current runs to the positive side of the coil through the ignition ballast resistor and the second diode. Further current runs through the closed oil pressure switch and closed thermal breaker switch to the positive pole of the starter's solenoid thereby cranking the motor. If the motor does not start within, for example a 30 second period allowed by the thermal circuit breaker, the circuit breaker opens and the starter will cease to operate. The breaker will then close again in, for example 10 seconds, and the starter will operate for another 30 seconds. If the car fails to start at all, the system will shut down at the end of the preselected period of, for example 6–8 minutes. If the car starts, then the oil pressure will increase and the oil pressure switch will open and will break the circuit running to the starter solenoid which will stop the starter from operating. Also within the circuit is a line from the set of contact points at the throttle solenoid which runs through a diode to the accessory side of the ignition switch in order to provide power to the heater fans, defroster and other accessory units of the vehicle that the user wishes to have operate once the vehicle's has started. It should be noted that in modern vehicles while the starter solenoid is operating, none of the accessories will function. Therefore no drain will be placed upon the battery through this line until the starter motor has stopped. This line also runs through a diode which is protective in nature to prevent any surge of current feedback. Also the diodes on either line running to the positive pole of the coil prevent any feedback from the coil to the solenoid and switches of the system. Also it should be noted that the lines running from the ignition switch also have interposed thereon diodes to prevent any backflow of current from the device of this invention to the ignition switch itself.

The device of this invention will become clearer with reference to the attached drawing and description of the preferred embodiment.

DESCRIPTION OF THE PREFERRED EMBODIMENT

FIG. 1 illustrates a schematic view of the device of this invention. Seen in this view is the power source of the vehicle being 12 volt battery 10 illustrated as an example. The positive pole of battery 10 is attached by a line through a slow-blow fuse 12 to one of a first set of contacts 16 which are controlled by clock 14 to close at a time that is preset within the clock, the clock being of the type adapted to open contact points 16 after a preselected period, for example 6–8 minutes. The other of the first set of contacts 16, when closed, conducts the 12 volt current to a key-operated single pole single-throw switch 18 which will, when closed, activate the system of the device of this invention. A line runs from switch 18 conducting the current to a solenoid 20, one pole of which is grounded and which is located at the carburetor of the vehicle and has a member thereof interconnected to the throttle linkage 26 and is adapted when current runs through the solenoid to pull down on the throttle and close the choke of the vehicle. The throttle linkage 26 has therein a slot 21 for the top catch member of the solenoid to be inserted therein to allow the throttle to move freely when being normally activated by the accelerator pedal so that the device of this invention will not interfere with the normal operation of the vehicle. The solenoid can have a length of pull adjustment member 22 which can be screw-threaded to adjust for the maximum opening for a cold engine to achieve a fast idle speed. When the solenoid activates the throttle of the vehicle, it closes the second set of contact points 24. This continues the circuit carrying the 12 volts which runs along line 25 to an oil pressure switch 36 which is normally closed but which is adapted to open when the vehicle's engine starts and the oil pressure increases. While the engine is off and the oil pressure switch is closed, a line from the oil pressure switch 36 runs to a thermal circuit breaker 38 which is sensitive to the current of the battery and which will open if the current passes through the breaker after a period of 30 seconds, for example. Thermal circuit breaker 38 is adapted to be of the type to close after a 10 second period, for example. The line from the thermal breaker 38 continues to the positive pole of the starter solenoid 40. Also line 25 runs from the second set of contact points 24 to the ignition ballast resistor 34 and through a second diode 42 to the positive side of the coil 46. A line also runs from the positive pole of the starter solenoid 40 through a first diode 44 to the positive side of the coil 46. It should be noted that most cars are adapted for the starter to stop automatically if the oil pressure rises. In any case when the oil pressure does rise, which may take several seconds, the oil pressure switch can be a standard part of the vehicle, will open and will break the circuit stopping current from running to starter solenoid 40 thereby stopping the starter from operating. If the vehicle does not start, the oil pressure of course will not rise and the oil pressure switch will remain closed. Therefore a means to stop the battery from cranking the starter for too long a period of time must be utilized. This means is within the device of this invention being thermal circuit breaker 38 which will allow the current to pass therethrough for a period of 30 seconds, for example, and if the engine has not started and the oil pressure switch has not opened to stop the starter, then the thermal breaker switch after that 30 second period will break ceasing the operation of the starter. In order to have the starter crank more than once, the thermal circuit breaker switch is adapted to close after a period of time which is cited herein for example as 10 seconds and it will again crank the starter for 30 seconds. This will continue for the full period that the timing device has closed contact point 16. If the car fails to start, then the owner will have to start it in the normal fashion. In this way the car will attempt to start for a number of times over the 6–8 minute period. The current along line 25 also runs through the ignition ballast resistor 30 through second diode 42 to the positive side of coil 46. This will allow for the supplying of current to the distributor and the electrical system of the motor of the vehicle for its continued running once the starter motor ceases to run. An additional line extending off line 25 runs to a third diode 28 and to the accessory side of the ignition switch which will, once the motor vehicle has started, start the operation of, and provide power to, the heater, defroster, and other accessory units. Modern cars will not operate these accessories while the starter is in operation. Therefore the interconnection to these current-draining electrical accessories will not drain the battery unduly and after the vehicle has started, the current will be normally provided therefor from the alternator of the vehicle. In addition there runs from the ignitio switch "on" pole 50 to the positive side of the coil a line upon which is interposed diode 48 positioned so as to prevent any backfeed of current to the ignition switch "on" pole 50. Also positioned on a line running from the starter solenoid to ignition switch 52 is diode 54 to prevent any backflow of current to the start portion of the ignition switch while the device of this invention is in operation.

Although the present invention has been described with reference to particular embodiments, it will be apparent to those skilled in the art that variations and modifications can be substituted therefor without departing from the principles and spirit of the invention.

I claim:

1. An apparatus for automatically starting a motor vehicle internal combustion engine having throttle linkage on the carburetor thereof, a power source, a starter motor with a starter solenoid associated therewith being interconnected to a coil, an ignition ballast resistor, an ignition switch having an "on", "start", and "accessory" pole positions, said "on" position pole connected by a line to said coil and "start" position pole connected by a line to said starter solenoid, comprising:

a first pair of contact points, the first of which is connected to said power source;

a clock timer adapted to be preset to close said contact points for a discrete period of time;

a key-operated switch having a first and second pole, the first pole of which is connected to the second of said first pair of contact points;

a solenoid connected to the second pole of said key-operated switch and adapted to activate said throttle linkage;

a second pair of contact points, the first of which is connected to the line running from said key-operated switch to said solenoid, said second pair of contact points adapted to be closed when said solenoid is activated;

an oil pressure sensor controlled switch having a first and second pole, the first pole of which is connected with the second contact of said second pair of contact points, said oil pressure switch being adapted to open due to the increase in oil pressure when said engine starts;

a thermal circuit breaker having a first and second pole, the first pole of which is connected to the second pole of said oil pressure switch, said thermal circuit breaker being adapted that when current passes therethrough for a first preselected time to open and then to close after a second preselected time, the second pole of said thermal circuit breaker being connected to the starter solenoid;

a first diode interposed along the line between said starter solenoid and said coil, adapted to prevent the flow of current from said coil to said starter solenoid;

a first line running from said second contact of said second pair of contact points through said ignition ballast resistor to said coil;

a second diode interposed along said first line between said ignition ballast resistor and said coil, adapted to prevent current from traveling from said coil to said ignition ballast resistor;

a second line running from said second contact of said second pair of contact points to said ignition switch accessory pole;

a third diode interposed along said second line between said second contact point of said solenoid and said ignition switch accessory pole, adapted to prevent current flow from said ignition switch accessory pole to said second contact point of said second pair of contact points;

a fourth diode interposed on said line running from said ignition "on" pole to said coil, adapted to prevent current from flowing from said coil to said ignition switch "on" pole; and a fifth diode interposed on said line from said ignition switch "start" pole to said starter solenoid, adapted to prevent current from flowing from said starter solenoid to said ignition switch "start" pole.

2. The device of claim 1 further including means for the interconnection between said solenoid and said throttle linkage which allow for unimpeded movement of said throttle linkage member during normal operation of said vehicle.

* * * * *